US007821208B2

(12) United States Patent
Baarman et al.

(10) Patent No.: US 7,821,208 B2
(45) **Date of Patent: *Oct. 26, 2010**

(54) INDUCTIVELY-POWERED GAS DISCHARGE LAMP CIRCUIT

(75) Inventors: David W. Baarman, Fennville, MI (US); Scott A. Mollema, Rockford, MI (US); Ronald L. Stoddard, Kentwood, MI (US); Joshua K. Schwannecke, Grand Rapids, MI (US)

(73) Assignee: Access Business Group International LLC, Ada, MI (US)

( * ) Notice: Subject to any disclaimer, the term of this patent is extended or adjusted under 35 U.S.C. 154(b) by 962 days.

This patent is subject to a terminal disclaimer.

(21) Appl. No.: 11/620,840

(22) Filed: Jan. 8, 2007

(65) Prior Publication Data

US 2008/0164817 A1 Jul. 10, 2008

(51) Int. Cl.
*H05B 37/00* (2006.01)

(52) U.S. Cl. ..... 315/244; 315/239; 315/274; 315/291; 315/307

(58) Field of Classification Search ..... 315/274–278, 315/239, 240, 244, 246, 291, 307, 362, 209 R, 315/312
See application file for complete search history.

(56) References Cited

U.S. PATENT DOCUMENTS

| | | | |
|---|---|---|---|
| 3,710,177 | A | 1/1973 | Ward |
| 4,523,131 | A | 6/1985 | Zansky |
| 4,525,648 | A | 6/1985 | De Bijl et al. |
| 4,525,649 | A | 6/1985 | Knoll et al. |
| 5,218,272 | A | 6/1993 | Jones |
| 5,345,149 | A | 9/1994 | Ham |
| 5,404,082 | A | 4/1995 | Hernandez et al. |

(Continued)

FOREIGN PATENT DOCUMENTS

| | | | |
|---|---|---|---|
| EP | 0930808 | A | 7/1999 |

(Continued)

OTHER PUBLICATIONS

Notification of Transmittal of the International Search Report and the Written Opinion of the International Searching Authority, or the Declaration, Dec. 21, 2007.

*Primary Examiner*—Haissa Philogene
(74) *Attorney, Agent, or Firm*—Warner Norcross & Judd LLP

(57) ABSTRACT

An inductively powered gas discharge lamp assembly having a secondary circuit with starter circuitry that provides pre-heating when power is supplied to the secondary circuit at a pre-heat frequency and that provides normal operation when power is supplied to the secondary circuit at an operating frequency. In one embodiment, the starter circuitry includes a pre-heat capacitor connected between the lamp electrodes and an operating capacitor located between the secondary coil and the lamp. The pre-heat capacitor is selected so that the electrical flow path through the pre-heat capacitor has a lesser impedance than the electrical flow path through the gas of the lamp when power is applied to the secondary circuit at the pre-heat frequency, and so that the electrical flow path through the pre-heat capacitor has a greater impedance than the electrical flow path through the gas when power is applied the operating frequency. The primary circuit may include a tank circuit for which the resonant frequency can be adjusted to match the pre-heat frequency and the operating frequency.

20 Claims, 5 Drawing Sheets

U.S. PATENT DOCUMENTS 5,493,182 A 2/1996 Sowa et al.
5,550,436 A 8/1996 Houk
5,589,740 A 12/1996 Rudolph et al.
5,608,292 A 3/1997 Konopka et al.
5,612,597 A 3/1997 Wood
5,761,056 A 6/1998 Noh
5,825,136 A 10/1998 Rudolph
5,828,187 A 10/1998 Fischer
5,831,396 A 11/1998 Rudolph
5,925,984 A 7/1999 Fischer et al.
6,051,936 A 4/2000 Qian
6,100,642 A 8/2000 Kim
6,140,779 A * 10/2000 Kanazawa et al. ..... 315/291
6,285,138 B1 9/2001 Kataoka et al.
6,555,970 B2 4/2003 Schemmel et al.
6,731,071 B2 * 5/2004 Baarman ..... 315/51
6,744,219 B2 6/2004 Neidlinger
6,788,001 B2 9/2004 Lechner
6,806,649 B2 * 10/2004 Mollema et al. ..... 315/96
6,806,657 B2 10/2004 Rudolph et al.
6,812,645 B2 * 11/2004 Baarman ..... 315/56
6,825,620 B2 * 11/2004 Kuennen et al. ..... 315/224
6,831,417 B2 * 12/2004 Baarman ..... 315/51
6,917,163 B2 7/2005 Baarman
7,119,494 B2 10/2006 Hui et al.
7,153,178 B2 * 12/2006 Baarman ..... 445/27
7,474,058 B2 * 1/2009 Baarman ..... 315/51
7,521,873 B2 4/2009 Hui et al.
7,592,753 B2 * 9/2009 Baarman et al. ..... 315/274
2002/0050796 A1 5/2002 Huber
2002/0113556 A1 8/2002 Tao et al.
2003/0011328 A1 1/2003 Schemmel et al.
2003/0076055 A1 4/2003 Hooijer et al.
2004/0174122 A1 9/2004 Ribarich
2005/0093475 A1 5/2005 Kuennen et al.
2005/0110429 A1 5/2005 Poon et al.
2005/0156534 A1 7/2005 Oh
2005/0174069 A1 8/2005 Van Den Berg
2005/0237008 A1 10/2005 Moisin
2006/0033450 A1 2/2006 Feldtkeller et al.

FOREIGN PATENT DOCUMENTS

EP 0948243 A 10/1999
EP 0774199 B1 3/2003
JP 2002203695 7/2002
WO 9716054 5/1997

* cited by examiner

INDUCTIVELY-POWERED GAS DISCHARGE LAMP CIRCUIT

BACKGROUND OF THE INVENTION

The present invention relates to gas discharge lamps, and more particularly to circuits for starting and powering gas discharge lamps.

Gas discharge lamps are used in a wide variety of applications. A conventional gas discharge lamp includes a pair of electrodes spaced apart from one another within a lamp sleeve. Gas discharge lamps are typically filled with an inert gas. In many applications, a metal vapor is added to the gas to enhance or otherwise affect light output. During operation, electricity is caused to flow between the electrodes through the gas. This causes the gas to discharge light. The wavelength (e.g. color) of the light can be varied by using different gases and different additives within the gas. In some applications, for example, conventional fluorescent lamps, the gas emits ultraviolet light that is converted to visible light by a fluorescent coating on the interior of the lamp sleeve.

Although the principles of operation of a conventional gas discharge lamp are relatively straightforward, conventional gas discharge lamps typically require a special starting process. For example, the conventional process for starting a conventional gas discharge lamp is to pre-heat the electrode to produce an abundance of electron around the electrodes (the "pre-heat" stage) and then to apply a spike of electrical current to the electrodes with sufficient magnitude for the electricity to arc across the electrodes through the gas (the "strike" stage). Once an arc has been established through the gas, the power is reduced as significantly less power is required to maintain operation of the lamp.

In many applications, the electrodes are pre-heated by connecting the electrodes in series and passing current through the electrodes as though they were filaments in an incandescent lamp. As current flows through the electrodes, the inherent resistance of the electrodes results in the excitation of electrons. Once the electrodes are sufficiently pre-heated, the direct electrical connection between the electrodes is opened, thereby leaving a path through the gas as the only route for electricity to follow between the electrodes. At roughly the same time, the power applied to the electrodes is increased to provide sufficient potential difference for electrons to strike an arc across the electrodes.

Starter circuits come in a wide variety of constructions and operate in accordance with a wide variety of methods. In one application, the power supply circuit includes a pair of transformers configured to apply pre-heating current across the two electrodes only when power is supplied over a specific range. By varying the frequency of the power, the pre-heating operation can be selectively controlled. Although functional, this power supply circuit requires the use of two additional transformers, which dramatically increase the cost and size of the power supply circuit. Further, this circuit includes a direct electrical connection between the power supply and the lamp. Direct electrical connections have a number of drawbacks. For example, direct electrical connections require the user to make electrical connections (and often mechanical connections) when installing or removing the lamp. Further, direct electrical connections provide a relatively high risk of electrical problems bridging between the power supply and the lamp.

In some applications, the gas discharge lamp is provided with power through an inductive coupling. This eliminates the need for direct electrical connection, for example, wire connections and also provides a degree of isolation between the power supply and the gas discharge lamp. Although an inductive coupling provides a variety of benefits over direct electrical connections, the use of an inductive coupling complicates the starting process. One method for controlling operation of the starter circuit in an inductive system is to provide a magnetically controlled reed switch that can be used to provide a selective direct electrical connection between the electrodes. Although reliable, this starter configuration requires close proximity between the electromagnet and the reed switch. It also requires a specific orientation between to the two components. Collectively, these requirements can place meaningful limitations on the design and configuration of the power supply circuit and the overall lamp circuit.

SUMMARY OF THE INVENTION

The present invention provides an inductive power supply circuit for a gas discharge lamp that is selectively operable in pre-heat and operating modes through variations in the frequency of power applied to the secondary circuit. In one embodiment, the power supply circuit generally includes a primary circuit with a frequency controller for varying the frequency of the power applied to the primary coil and a secondary circuit with a secondary coil for inductively receiving power from the primary coil, a gas discharge lamp and a pre-heat capacitor. The pre-heat capacitor is selected to pre-heat the lamp when the primary coil is operating within the pre-heat frequency range and to allow normal lamp operation when the primary coil is operating within the operating frequency range. In one embodiment, the pre-heat capacitor is connected in series between the lamp electrodes.

In one embodiment, the pre-heat capacitor, pre-heat frequency and operating frequency are selected so that the impedance of the electrical path through the lamp is greater than the impedance of the electrical path through the electrodes at the pre-heat frequency, and so that the impedance of the electrical path through the lamp is lesser than the impedance of the electrical path through the electrodes at the operating frequency.

In one embodiment, the secondary circuit further includes an operating capacitor disposed in series between the secondary coil and the lamp. The capacitance of the operating capacitor may be selected to substantially balance the inductance of the secondary coil. In this embodiment, the pre-heat capacitor may have a capacitance that is approximately equal to the capacitance of the operating capacitor.

In one embodiment, the primary circuit is adaptive to permit the primary to operate at resonance at the pre-heat frequency and at the operating frequency. In one embodiment, the primary circuit includes a tank circuit with variable capacitance and a controller capable of selectively varying the capacitance of the tank circuit. The primary circuit may include alternative circuitry for varying the resonant frequency of the tank circuit, such as a variable inductor.

In one embodiment, the variable resonance tank circuit includes a plurality of capacitors that may be made selectively operational by actuation of one or more switches. The switch (es) may be actuatable between a first position in which the effective capacitance of the tank circuit is set to provide resonance of the primary at approximately the pre-heat frequency and a second position in which the effective capacitance of the tank circuit is set to provide resonance of the primary at approximately the operating frequency.

In one embodiment, the tank circuit may include a tank operating capacitor that is connected between the primary coil and ground and a tank pre-heat capacitor that is connected between the primary and ground along a switched line in parallel to the pre-heat capacitor. In operation, the switch may be actuated to selectively enable or disable the pre-heat capacitor, thereby switching the resonant frequency of the primary between the pre-heat frequency and the operating frequency.

In another aspect, the present invention provides a method for starting and operating a gas discharge lamp. In one embodiment of this aspect, the method may include the steps of pre-heating the lamp by applying power to the secondary circuit at a pre-heat frequency at which the impedance of the electrical path through the lamp is greater than the impedance of the electrical path through the pre-heat capacitor for a period of time sufficient to pre-heat the lamp, and operating the lamp by applying power to the secondary circuit at an operating frequency at which the impedance of the electrical path through the lamp is lesser than the impedance of the electrical path through the pre-heat capacitor.

In one embodiment, the pre-heat frequency corresponds approximately to the resonant frequency of the secondary circuit taking into consideration the combined capacitance of the pre-heat capacitor and the operating capacitor, and the operating frequency corresponds approximately to the resonant frequency of the secondary circuit taking into consideration only the capacitance of the operating capacitor.

In one embodiment, the method further includes the step of varying the resonance frequency of the primary to match the pre-heat frequency during the pre-heating step and to match the operating frequency during the operating step. In one embodiment, this step is further defined as varying the effective capacitance of the tank circuit between the pre-heating step and the operating step. In another embodiment, this step is further defined as varying the effective inductance of the tank circuit between the pre-heating step and the operating step.

The present invention provides a simple and effective circuit and method for pre-heating, starting and powering a gas discharge lamp. The present invention utilizes a minimum number of components to achieve complex functionality. This reduces the overall cost and size of the circuitry. The present invention also provides the potential for improved reliability because it includes a small number of components, the components are passive in nature and there is less complexity in the manner of operation. In typical applications, the system automatically starts (or strikes) the lamp when the primary circuit switches from the pre-heat frequency to the operating frequency. The initial switch causes sufficient voltage to build across the electrodes to permit electricity to arc across the electrodes through the gas. Once the lamp has been started, the impedance through the lamp drops even farther creating a greater difference between the impedance of the electrical path through the lamp and the electrical path through the pre-heat capacitor. This further reduces the amount of current that will flow through the pre-heat capacitor during normal operation. In applications in which the resonant frequency of the primary circuit is selectively adjustable, the primary circuit can be adapted to provide efficient resonant operation during both pre-heat and operation. Further, the components of the secondary circuit can be readily incorporated into a lamp base, thereby facilitating practical implementation.

These and other objects, advantages, and features of the invention will be readily understood and appreciated by reference to the detailed description of the current embodiment and the drawings.

DESCRIPTION OF THE CURRENT EMBODIMENT

Figure 1:
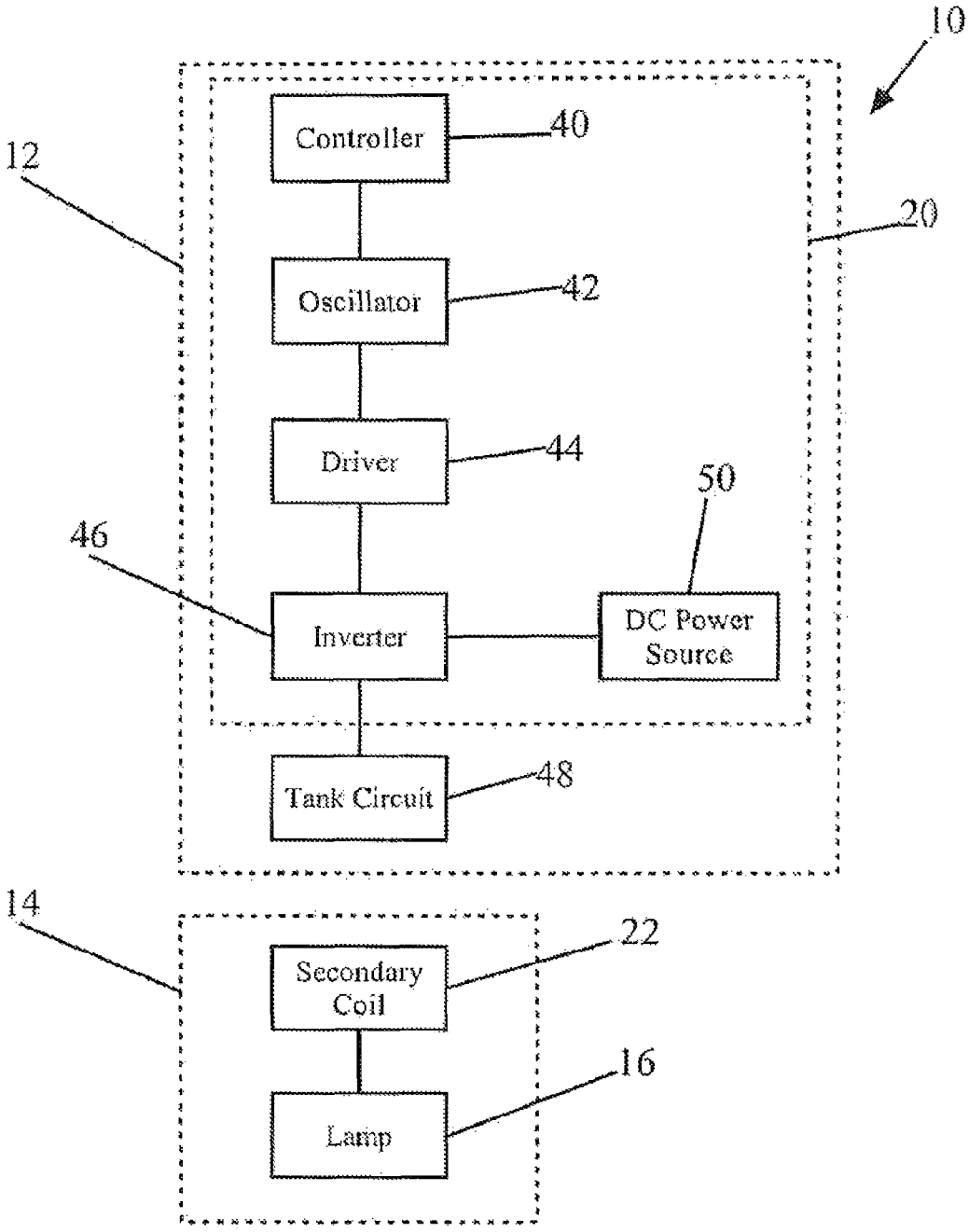
FIG. 1 is a schematic diagram of a gas discharge lamp system in accordance with an embodiment of the present invention.

A gas discharge lamp system 10 in accordance with one embodiment of the present invention is shown in FIG. 1. The gas discharge lamp system 10 generally includes a primary circuit 12 and a secondary circuit 14 powering a gas discharge lamp 16. The primary circuit 12 includes a controller 20 for selectively varying the frequency of the power inductively transmitted by the primary circuit 12. The secondary circuit 14 includes a secondary coil 22 for inductively receiving power from the primary coil 18 and a gas discharge lamp 16. The secondary coil 22 further includes an operating capacitor 30 connected between the secondary coil 22 and the lamp 16 and a pre-heat capacitor 32 connected in series between the lamp electrodes 24 and 26. In operation, the controller 20 pre-heats the lamp 16 by applying power to the secondary circuit 14 at a pre-heat frequency selected so that the impedance of the electrical path through the pre-heat capacitor 32 is less than the impedance of the electrical path through the gas in the gas discharge lamp 16. After pre-heating, the controller 20 applies power to the secondary circuit 14 at an operating frequency selected so that the impedance of the electrical path through the pre-heat capacitor 32 is greater than the impedance of the electrical path through the gas in the gas discharge lamp 16 This causes the pre-heat capacitor 32 to become "detuned," which, in turn, results in the flow of electricity along the electrical path through the gas in the gas discharge lamp 16.

As noted above, a schematic diagram of one embodiment of the present invention is shown in FIG. 1. In the illustrated embodiment, the primary circuit 12 includes a primary coil 18 and a frequency controller 20 for applying power to the primary coil 18 at a desired frequency. The frequency controller 20 of the illustrated embodiment generally includes a microcontroller 40, an oscillator 42, a driver 44 and an inverter 46. The oscillator 42 and driver 44 may be discrete components or they may be incorporated into the microcontroller 40, for example, as modules within the microcontroller 40. In this embodiment, these components collectively drive a tank circuit 48. More specifically, the inverter 46 provides AC (alternating current) power to the tank circuit 48 from a source of DC (direct current) power 50. The tank circuit 48 includes the primary coil 18 and may also include a capacitor 52 selected to balance the impedance of the primary coil 18 at anticipated operating parameters. The tank circuit 48 may be either a series resonant tank circuit or a parallel resonant tank circuit.

In this embodiment, the driver 44 provides the signals necessary to operate the switches within the inverter 46. The driver 44, in turn, operates at a frequency set by the oscillator 42. The oscillator 42 is, in turn, controlled by the microcontroller 40. The microcontroller 40 could be a microcontroller, such as a PIC18LF1320, or a more general purpose microprocessor. The illustrated primary circuit 12 is merely exemplary, and essentially any primary circuit capable of providing inductive power at varying frequencies may be incorporated into the present invention. The present invention may be incorporated into the inductive primary shown in U.S. Pat. No. 6,825,620 to Kuennen et al, which is entitled "Inductively Coupled Ballast Circuit" and was issued on Nov. 30, 2004. U.S. Pat. No. 6,825,620 is incorporated herein by reference.

Figure 2:
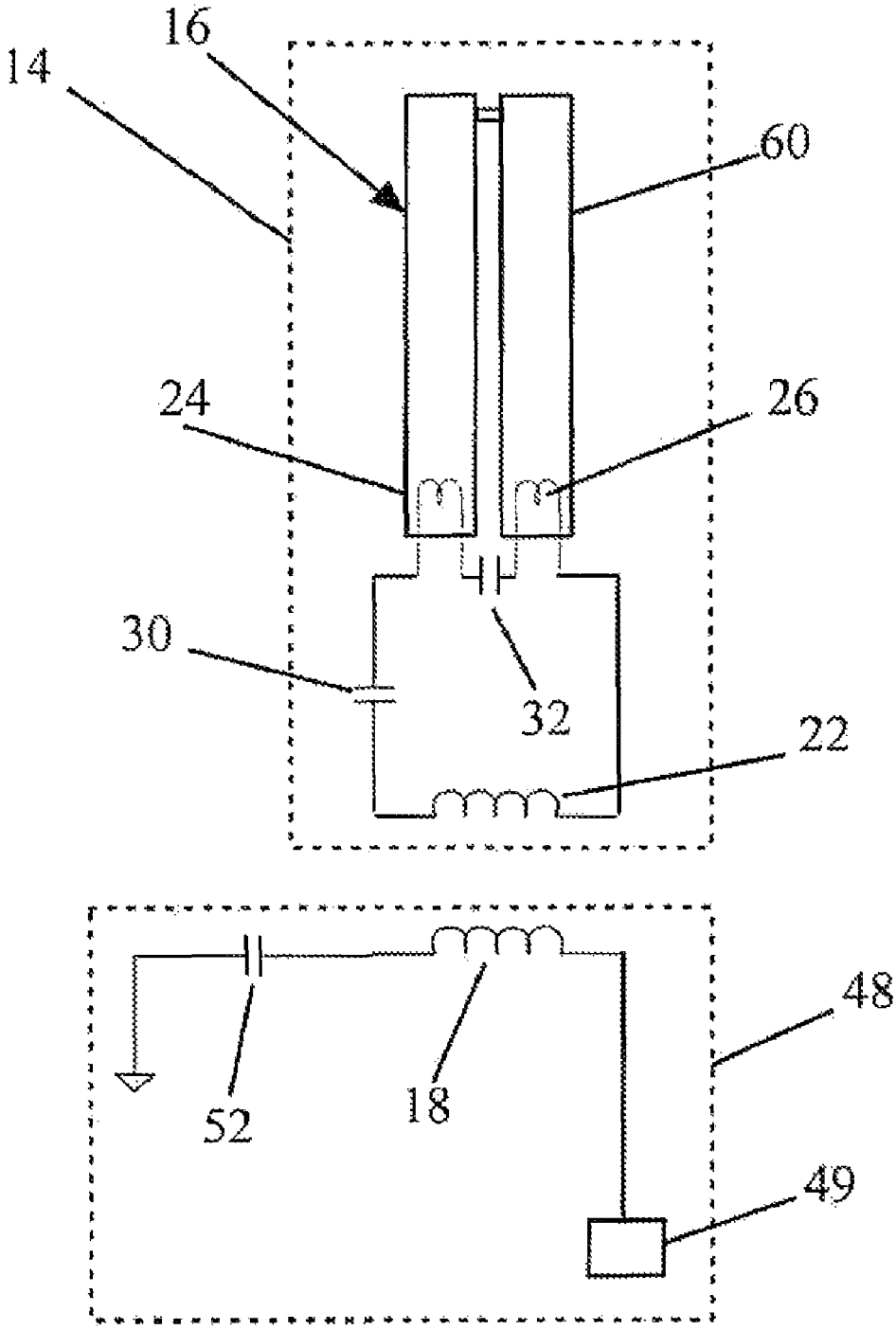
FIG. 2 is a circuit diagram of the secondary circuit and the tank circuit.

As noted above, the secondary circuit 14 includes a secondary coil 22 for inductively receiving power from the primary coil 18, a gas discharge lamp 16, an operating capacitor 30 and a pre-heat capacitor 32. Referring now to FIG. 2, the gas discharge lamp 16 includes a pair of electrodes 24 and 26 that are spaced apart from one another within a lamp sleeve 60. The lamp sleeve 60 contains the desired inert gas and may also include a metal vapor as desired. The lamp 16 is connected in series across the secondary coil 22. In this embodiment, the first electrode 24 is connected to one lead of the secondary coil 22 and the second electrode 26 is connected to the opposite lead of the secondary coil 22. In this embodiment, the operating capacitor 30 is connected in series between the secondary coil 22 and the first electrode 24 and the pre-heat capacitor 32 is connected in series between the first electrode 24 and the second electrode 26. In FIG. 2, the tank circuit 48 is shown with primary coil 18 and capacitor 52. Although not shown in FIG. 2, the tank circuit 48 is connected to the inverter 46 by connector 49.

Figure 3:
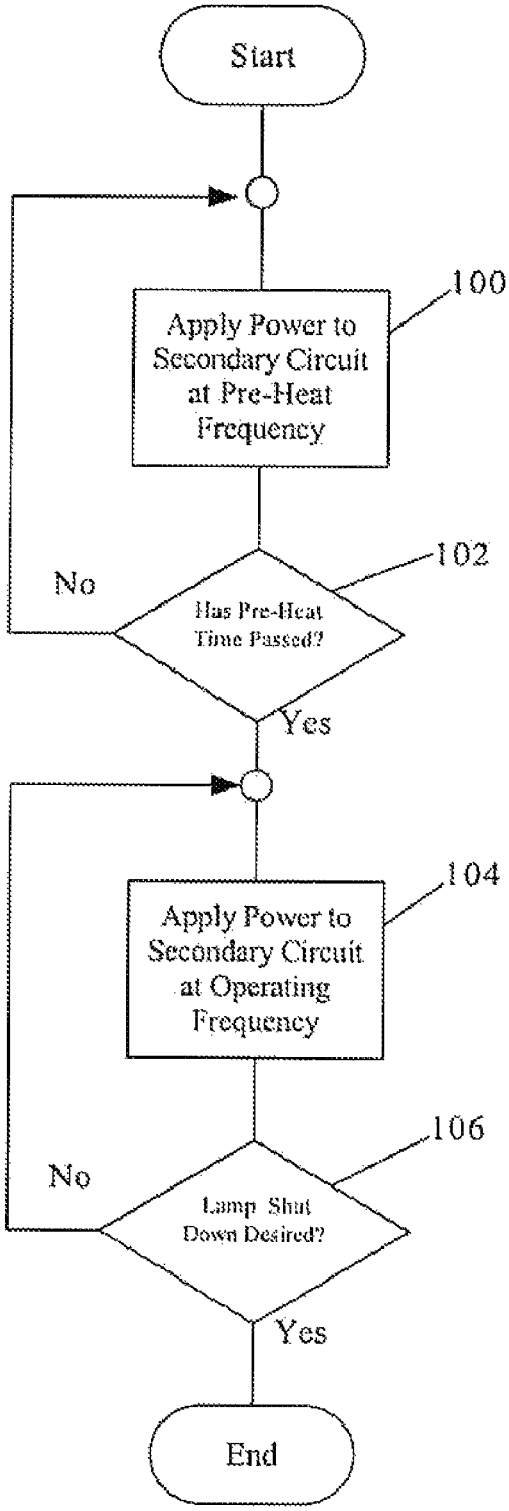
FIG. 3 is a flow chart showing the general steps of a method for starting and operating a gas discharge lamp.

Operation of the system 10 is described with reference to FIG. 3. The method generally includes the steps of applying 100 power to the secondary circuit 14 at a pre-heat frequency. The pre-heat frequency is selected as a frequency in which the impedance of the electrical path through the lamp is greater than the electrical path through the pre-heat capacitor 32. In one embodiment, the frequency controller 20 pre-heats the lamp 16 by applying power to the secondary circuit 14 at a pre-heat frequency approximately equal to the series resonant frequency of the operating capacitor 30 and the pre-heat capacitor 32, referred to as fs. A formula for calculating fs in this embodiment is set forth below. At the pre-heat frequency, the pre-heat capacitor 32 is sufficiently tuned to provide a direct electrical connection between the electrodes 24 and 26. This permits the flow of electricity directly across the electrodes 24 and 26 through the pre-heat capacitor 32. This flow of current pre-heats the electrodes 24 and 26. The system 10 continues to supply power at the pre-heat frequency until the electrodes 24 and 26 are sufficiently pre-heated 102. The duration of the pre-heating phase of operation will vary from application to application, but will typically be a predetermined period of time and is likely to be in the range of 1-5 seconds for conventional gas discharge lamps. After pre-heating, the controller 20 applies 104 power to the secondary circuit 14 at an operating frequency selected as a frequency in which the impedance of the electrical path through the lamp is lesser than the electrical path through the pre-heat capacitor 32. In this embodiment, the operating frequency is approximately equal to the resonant frequency of the operating capacitor 30, referred to as fo. A formula for calculating fs in this embodiment is set forth below. This change in frequency causes the pre-heat capacitor 32 to become detuned, which, in effect, causes current to flow through the lamp 16. Although the change in frequency will not typically cause the pre-heat capacitor to act as an open circuit, it will limit the flow of current through the pre-heat capacitor a sufficient amount to cause current to arc through the gas in the gas discharge lamp 16. As a result, the switch to operating frequency causes the power generated in the secondary circuit 14 follows an electrical path from one electrode 24 to the other electrode 26 through the gas in the lamp sleeve 60. Initially, this change in frequency will cause the lamp to start (or to strike) as the detuned pre-heat capacitor permits a sufficient voltage to build across the electrodes 24 and 26 to cause the current to arc through the gas. After the lamp has started, the lamp will continue to run properly at the operating frequency. In other words, a single change in the frequency applied to the secondary circuit 16 causes the lamp to move from the pre-heat phase through the starting (or striking) phase and into the operating phase.

$$fo := \frac{1}{2\pi\sqrt{L \cdot C1}}$$

$$fs := \frac{1}{2\pi\sqrt{L \cdot \left(\frac{C1 \cdot C2}{C1 + C2}\right)}}$$

L=Secondary Coil Inductance
C1=Capacitance of Operating Capacitor
C2=Capacitance of Pre-heat capacitor
fs=Pre-heat frequency
fo=Operating Frequency Although the formulas provided for determining pre-heat frequency and operating frequency yield specific frequencies, the terms "pre-heat frequency" and "operating frequency" should each be understood in both the specification and claims to encompass a frequency range encompassing the computed "pre-heat frequency" and "operating frequency." Generally speaking, the efficiency of the system may suffer as the actual frequency gets farther from the computed frequency. In typical applications, it is desirable for the actual pre-heat frequency and the actual operating frequency to be within a certain percentage of the computed frequencies. There is not a strict limitation, however, and greater variations are permitted provided that the circuit continues to function with acceptable efficiency. For many applications, the preheat frequency is approximately twice the operating frequency. The primary circuit 12 may continue to apply power to the secondary circuit 14 until 106 continued operation of gas discharge lamp 16 is no longer desired.

Figure 4:
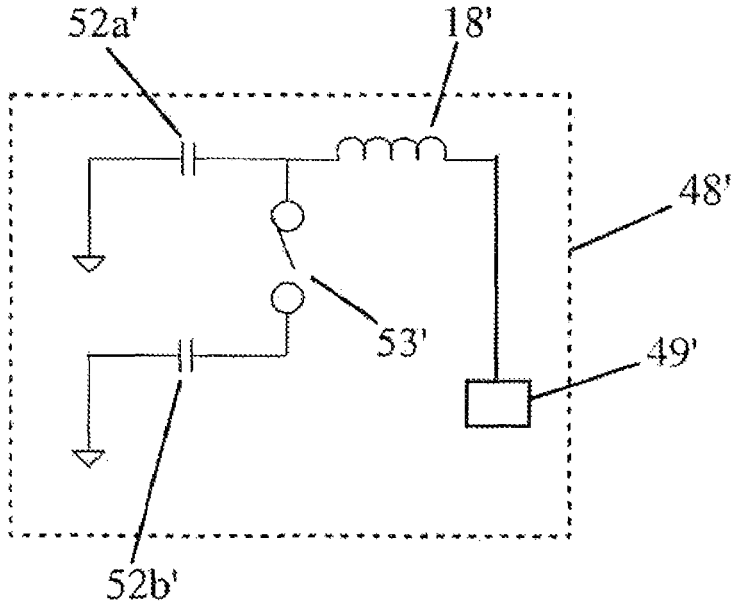
FIG. 4 is a circuit diagram of an alternative tank circuit.

If desired, the primary circuit 12' may be configured to have selectively adjustable resonance so that the primary circuit 12' operates at resonance at both the pre-heat frequency and the operating frequency. In one embodiment incorporating this functionality, the primary circuit 12' may include a variable capacitance tank circuit 48' (See FIG. 4) that permits the resonant frequency of the tank circuit 48' to be selectively adjusted to match the pre-heat frequency and the operating frequency. FIG. 4 shows a simple circuit for varying the capacitance of the tank circuit 48'. In the illustrated embodiment, the tank circuit 48' includes a tank operating capacitor **52*a*' connected between the primary coil 18' and ground and a tank pre-heat capacitor 52*b*' connected along a switched line between the primary coil 18' and ground in parallel with the tank operating capacitor 52*a*'. The switched line includes a switch 53' that is selectively operable to open the switched line, thereby effectively removing the tank pre-heat capacitor 52*b*' from the tank circuit 48'. Operation of the switch 53' may be controlled by the frequency controller 20, for example, by microcontroller 40, or by a separate controller. The switch 53'** may be essentially any type of electrical switch, such as a relay, FET, Triac or a custom AC switching devices.

Figure 5:
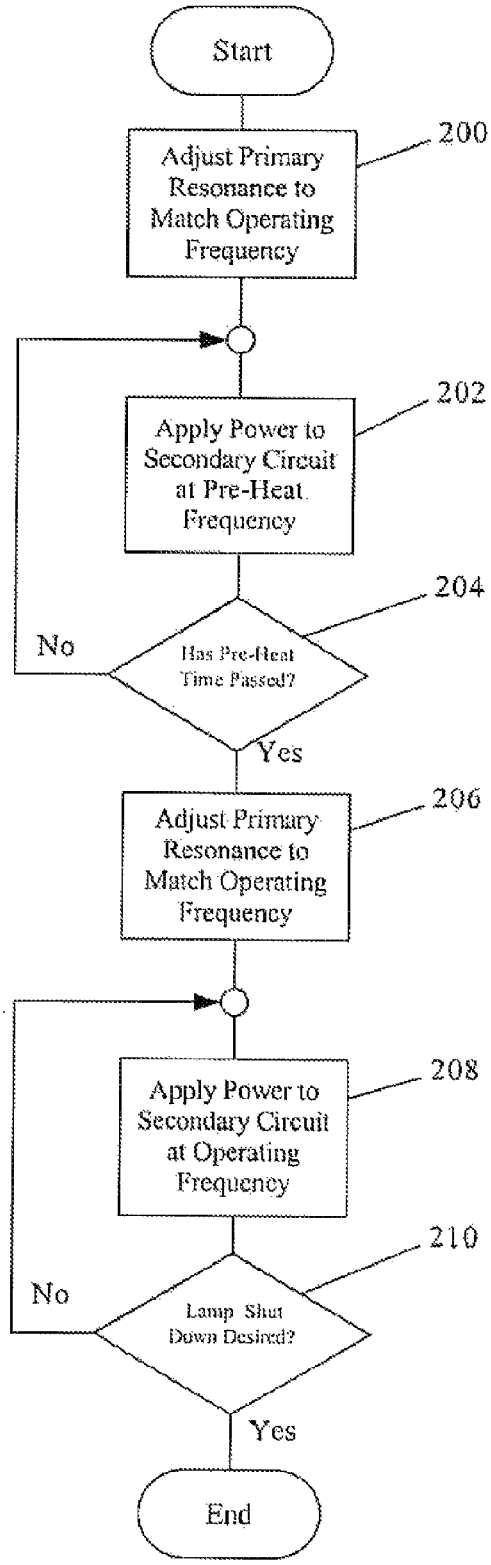
FIG. 5 is a flow chart showing the general steps of a method for starting and operating a gas discharge lamp.

Operation of this alternative is generally described with reference to FIG. 5. The primary circuit 12' adjusts 200 the resonant frequency of the tank circuit 48' to be approximately equal to the pre-heat frequency. The primary circuit 12' then supplies power 202 to the secondary circuit at the pre-heat frequency. The primary circuit 12' continues to supply power to the secondary circuit at the pre-heat frequency until the electrodes 24 and 26 have been sufficiently pre-heated 204. Once the electrodes are sufficiently pre-heated, the primary circuit 12' adjusts 206 the resonant frequency of the tank circuit 48' to be approximately equal to the operating frequency. The primary circuit 12' switches its frequency of operation to supply 208 power to the secondary circuit 14' at the operating frequency. The primary circuit 12' may continue to supply power until it is no longer desired 210. The system 10 may also include fault logic that ceases operation when a fault condition occurs (e.g. the lamp is burnt out or has been removed, or a short circuit has occurred).

Figure 6:
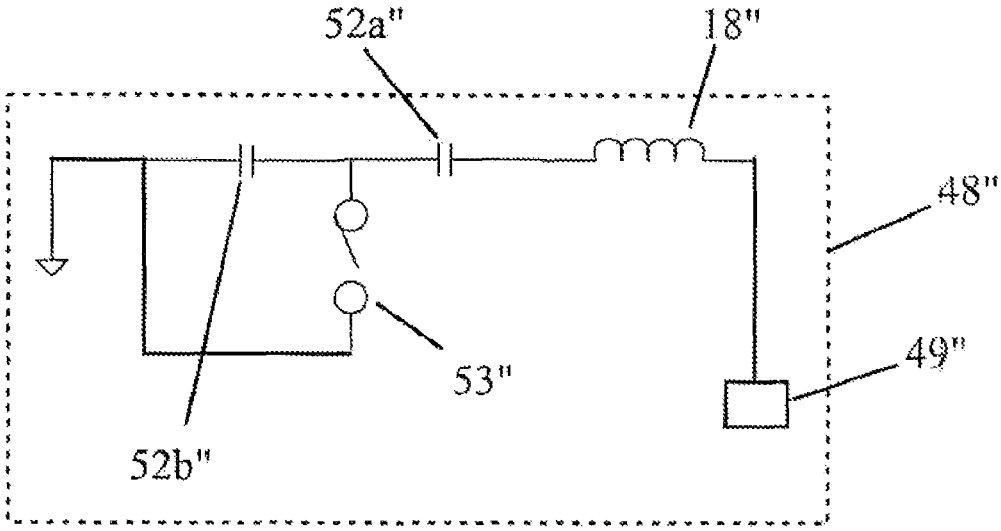
FIG. 6 is a circuit diagram of a second alternative tank circuit.

Variable capacitance may be implemented through the use of alternative parallel and series capacitance subcircuits. For example, FIG. 6 shows an alternative tank circuit 12" in which the tank pre-heat capacitor 52*b*" is connected in series with the tank operating capacitor 52*a*", but a switched line is included for shorting the circuit around the pre-heat capacitor 52*a*" by operation of switch 53" to effectively remove the pre-heat capacitor 52*b*" from the circuit.

Although described in connection with a variable capacitance tank circuit 48', the present invention extends to other methods for varying the resonant frequency of the tank circuit 48' or the primary circuit 12' between pre-heat and operating modes. For example, the primary circuit may include variable inductance. In this alternative (not shown), the tank circuit may include a variable inductor and a controller for selectively controlling the inductance of the variable inductor. As another example (not shown), the tank circuit may include a plurality of inductors that can be switched into and out of the circuit by a controller in much the same way as described above in connection with the variable capacitance tank circuit.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A secondary circuit for an inductively powered gas discharge lamp assembly comprising:

a lamp having a first electrode and a second electrode spaced apart within a gas;

a secondary coil electrically connected to said first electrode and said second electrode;

a pre-heat capacitor connected in series between said first electrode and said second electrode such that said pre-heat capacitor is opposite said secondary coil.

2. The secondary circuit of claim 1 wherein said pre-heat capacitor has characteristics selected such that an electrical flow path through said pre-heat capacitor has a lesser impedance than an electrical flow path through said gas when power is applied to the secondary circuit at a pre-heat frequency, and such that said electrical flow path through said pre-heat capacitor has a greater impedance than said electrical flow path through said gas when power is applied to the secondary circuit at an operating frequency.

3. The secondary circuit of claim 2 further including a second capacitor connected in series between said secondary coil and said first electrode.

4. The secondary circuit of claim 3 wherein said pre-heat frequency is approximately equal to a resonant frequency of said secondary coil, said pre-heat capacitor and said second capacitor.

5. The secondary circuit of claim 3 wherein said operating frequency is approximately equal to a resonant frequency of said secondary coil and said second capacitor.

6. A gas discharge lamp assembly comprising:

a primary circuit having a frequency controller and a primary coil;

a secondary circuit having a secondary coil, a gas discharge lamp, and a pre-heat capacitor, said gas discharge lamp having a first electrode and a second electrode spaced apart within a gas, said pre-heat capacitor being connected in series between said first electrode and said second electrode;

said frequency controller selectively operable at a pre-heat frequency at which said pre-heat capacitor prohibits flow of electricity from said first electrode to said second electrode through said gas and an operating frequency at which said pre-heat capacitor permits flow of electricity from said first electrode to said second electrode through said gas.

7. The assembly of claim 6 wherein said secondary circuit includes an operating capacitor.

8. The assembly of claim 7 wherein said operating capacitor is connected in series between said secondary coil and said first electrode.

9. The assembly of claim 8 wherein said pre-heat frequency is further defined as approximately equal to a series resonant frequency of said secondary coil, said pre-heat capacitor and said operating capacitor.

10. The assembly of claim 9 wherein said operating frequency is further defined as approximately equal to the resonant frequency of said secondary coil and said operating capacitor.

11. A method for starting and operating a gas discharge lamp having first and second electrodes spaced apart in a gas, comprising the steps of:

providing a secondary circuit having a secondary coil connected to the lamp and a pre-heat capacitor connected in series between the first electrode and the second electrode;

applying power to the secondary circuit at a pre-heat frequency at which the impedance of an electrical flow path through the pre-heat capacitor is lesser than the impedance of an electrical flow path through the gas; and applying power to the secondary circuit at an operating frequency at which the impedance of the electrical flow path through the pre-heat capacitor is greater than the impedance of the electrical flow path through the gas.

12. The method of claim 11 wherein said step of applying power at a pre-heat frequency is carried out for a period of time sufficient to pre-heat the lamp.

13. The method of claim 11 wherein said step of applying power at a pre-heat frequency is carried out for a predetermined period of time sufficient to pre-heat the lamp.

14. The method of claim 11 wherein the secondary circuit further includes an operating capacitor and wherein the preheat frequency is approximately equal to a resonant frequency of the secondary coil, operating capacitor and the pre-heat capacitor.

15. The method of claim 14 wherein the operating frequency is approximately equal to the resonant frequency of the secondary coil and the operating capacitor.

16. A method for starting and operating a gas discharge lamp having a pair of electrodes spaced apart within a gas, comprising the steps of:

providing a secondary circuit having a secondary coil connected to the lamp and a pre-heat capacitor connected electrically between the electrodes of the gas discharge lamp;

applying power to the secondary circuit at a pre-heat frequency selected to permit the flow of electricity from one of the electrodes to the other of the electrodes through the pre-heat capacitor; and applying power to the secondary circuit at an operating frequency selected to permit the flow of electricity from one of the electrodes to the other of the electrodes through the gas.

17. The method of claim 16 further comprising the step of providing the secondary circuit with an operating capacitor; and wherein said pre-heat frequency is approximately equal to a series resonant frequency of the secondary coil, operating capacitor and the pre-heat capacitor.

18. The method of claim 16 further comprising the step of providing the secondary circuit with an operating capacitor; and wherein said operating frequency is approximately equal to a series resonant frequency of the secondary coil and the operating capacitor.

19. The method of claim 16 wherein the pre-heat frequency is equal to approximately twice the operating frequency.

20. The method of claim 16 wherein said step of applying power at the pre-heat frequency is carried out for a period of time ranging from about 1 to about 5 seconds.

* * * * *